US008931469B2

(12) United States Patent
Kingsbury et al.

(10) Patent No.: US 8,931,469 B2
(45) Date of Patent: Jan. 13, 2015

(54) BILATERAL ADJUSTABLE QUIVER WITH RELEASABLE BOW ATTACHMENT

(76) Inventors: Klint McLean Kingsbury, Austin, TX (US); Clayton W. Reinarz, New Braunfels, TX (US)

( * ) Notice: Subject to any disclaimer, the term of this patent is extended or adjusted under 35 U.S.C. 154(b) by 462 days.

(21) Appl. No.: 13/439,832

(22) Filed: Apr. 4, 2012

(65) Prior Publication Data

US 2013/0092142 A1 Apr. 18, 2013

Related U.S. Application Data

(60) Provisional application No. 61/471,410, filed on Apr. 4, 2011.

(51) Int. Cl.
*F41B 5/06* (2006.01)

(52) U.S. Cl.
CPC ..... *F41B 5/066* (2013.01)
USPC ..... 124/88

(58) Field of Classification Search
CPC ..... F41B 5/066; F41B 5/148; F41B 5/06; F41B 5/063
USPC ..... 124/88, 86, 25.5, 25.7; 224/916
See application file for complete search history.

(56) References Cited

U.S. PATENT DOCUMENTS

| | | | |
|---|---|---|---|
| 2,980,305 | A | 4/1961 | Reese |
| 3,116,730 | A | 1/1964 | Tingley |
| 3,337,099 | A | 8/1967 | Rose |
| 4,156,496 | A | 5/1979 | Stinson |
| 4,995,372 | A | 2/1991 | Topel |
| 5,775,313 | A | 7/1998 | Bresette et al. |
| 6,006,734 | A | 12/1999 | Sodaro |
| 6,390,085 | B1 | 5/2002 | Stinson |
| 6,672,299 | B2 | 1/2004 | Proctor |
| 6,691,694 | B2 | 2/2004 | Stinson |
| 6,725,853 | B2 | 4/2004 | Foddrill |
| 7,077,119 | B1 | 7/2006 | Dube, Sr. et al. |
| 7,987,842 | B2 | 8/2011 | McPherson |
| 8,122,874 | B2 | 2/2012 | LoRocco et al. |
| 2003/0209237 | A1 | 11/2003 | Nickell |
| 2008/0302346 | A1 | 12/2008 | Notestine |

*Primary Examiner* — Kurt Fernstrom
*Assistant Examiner* — Amir Klayman
(74) *Attorney, Agent, or Firm* — Kammer Browning PLLC

(57) ABSTRACT

A quiver for holding arrows or bolts. The quiver may be releasably attached to a mounting rail on a bow, belt, or the like. The quiver includes a frame connecting two end structures, each end structure having arrow head pockets, arrow shaft clips, and a connector for attachment to the frame. At a midsection of the frame is a mounting block with an attachment mechanism for releasably securing the quiver to the mounting rail. The preferable mounting rail is of the Picatinny type. A first set of arrows (three in the preferred embodiment) may be positioned with arrow heads in the arrow head pockets of one end structure and arrow shafts in the arrow shaft clips of the second end structure. A second set of arrows is positioned in a similar manner but in the opposite direction between the end structures on the frame.

18 Claims, 11 Drawing Sheets

BILATERAL ADJUSTABLE QUIVER WITH RELEASABLE BOW ATTACHMENT

CROSS REFERENCES TO RELATED APPLICATIONS

This application claims the benefit under Title 35 United States Code §119(e) of U.S. Provisional Application 61/471,410 filed Apr. 4, 2011, the full disclosure of which is incorporated herein by reference.

BACKGROUND OF THE INVENTION

1. Field of the Invention

The present invention relates generally to quivers for holding arrows or bolts as used in archery. The present invention relates more specifically to a quiver for holding arrows or bolts in opposing directions so as to increase the number of arrows or bolts that can be retained. The present invention also relates to a manner of removably attaching the bilateral quiver to the bow.

2. Description of the Related Art

In archery or bow hunting, an archer requires the ability to carry multiple arrows. The carrying device for these arrows can be attached to the archer's bow or to the person directly. The more arrows carried on a bow or body by this carrying device creates more undesirable weight on the bow or on the body. The arrows also take up additional space. The device which holds these arrows (a quiver) is desired to be light weight, take up as little space is possible, and quickly attach and re-attach to the bow or body or both. It is also desirable that the arrows be held by this device as closely together as possible to minimize space consumption. As arrows are stacked together, the feathers and/or broadheads limit how closely the arrows can be held together when stacked in the same direction. Another problem faced by bow hunters is how to quickly and efficiently mount lights, lasers, cameras, and other accessories quickly and effectively to a bow. The proposed invention solves these problems.

The proposed invention solves the issue of containing the arrows as closely together as possible. It holds the arrows in two directions rather than in one direction. The arrows are alternated in direction as they are stacked together. The arrows can be stacked more closely together as their directions are alternated, because the feathered ends are no longer immediately next to each other. This greatly reduces the area consumed by the quiver and arrows. The configuration also reduces the weight. The proposed invention utilizes a standardized picatinny or weaver style rail system for attaching to the archers bow or body. This allows for quick attachment and reattachment, as well as a standardized connection platform for all bows and crossbows. The mounting of a standardized picatinny rail directly to the bow is another unique feature of the proposed invention that solves the problem of mounting lights, lasers, cameras, and other accessories quickly and easily to the bow.

Current quiver designs hold the arrows all facing the same direction and they utilize bow attachment platforms that are non-standard. The proposed invention holds the arrows by alternating their direction 180° in order to save space and weight as well as utilizing a standard picatinny rail quick-attach mounting system.

There are three main issues with current quiver designs that the proposed invention addresses. First, current quiver designs utilize holding systems that hold the arrows facing the same direction. This adds to the size of the quiver, as well as the weight. The proposed invention utilizes a holding system that alternates arrow direction 180°. This allows for arrows to be stacked more closely together than traditional quivers while maintaining independent pockets for each arrow point. The independent arrow point pockets prevent any broadhead interference that occurs with current quiver designs. The pockets protect the broadhead blades and prevent tangling.

Second, current arrow quivers mount to the bow with non-standard mounting systems. The mounting systems are almost always proprietary, so different quivers or accessories cannot be interchanged on the same mount. Many of the current mounting systems do not utilize quick attach designs. The proposed invention utilizes a quick-attach Picatinny rail mounting system. A standardized picatinny rail is bolted to the standard mounting holes on the bow. The proposed quiver has a quick attach levered system that attaches firmly onto the bow mounted rail. The proposed quiver can be quickly detached and replaced with any other Picatinny mounted device (laser, light, camera, etc.). This greatly adds to proposed quiver's functionality in the field.

Third, currently existing quivers do not have the ability to be adjusted for different arrow lengths. This prevents current quivers from being interchangeable between bows and crossbows. Due to the proposed invention holding the arrows in alternating directions, it incorporates a telescoping design that allows the quiver heads to be moved further apart or closer together to accommodate many different arrow lengths. The attachment mechanism is also movable within the framework so that it can be adjusted to fit any bow riser, as well as fit to a crossbow. This additional adjustability coupled with the standardized picatinny rail mounting system provides much greater versatility than currently existing quiver designs.

SUMMARY OF THE INVENTION

The basic elements of the present invention may be broadly described as follows. The quiver rack can be constructed of metal, polymer, plastic or composite. It is shaped into two shafts that run the between and support the two quiver heads. The shafts of the quiver rack form into supporting structure for the quiver heads. The supporting structure of the quiver rack can be formed with a truss-like structure to provide maximum support and rigidity, but with limited weight, or may, as in the preferred embodiment described below, be formed from simple rods. The quiver rack shafts run down the sides of the quick attach mechanism, as well as attach the rack to the mechanism. An alternate embodiment of the quiver rack consists of telescoping shafts. These shafts slide into each other so that the distance between the quiver heads can be adjusted.

The quiver head can be constructed of rubber, plastic or composite. The preferred embodiment is rubber due to its ability to flex around the arrow shaft at the arrow shaft slot. However, a more rigid material could be utilized along with o-rings embedded into the arrow slots to flex and accept the arrow in an alternate embodiment. The quiver head design is comprised of two or more broadhead pockets, and two or more arrow shaft slots. The preferred embodiment is three pockets and three slots. The broadhead pockets are unique to this design and are sized to cover the blades of the broadhead and protect the archer, as well as the blades themselves. The preferred embodiment of the pocket will utilize foam in the bottom to cushion and secure the arrow point or broadhead. The rubber construction of the quiver head also allows for the arrows to act as counter weights that will absorb vibration from the bow.

The quick attach mechanism is constructed from metal (preferably aluminum), composite or polymer. It is designed to accommodate the rails (or rods) of the quiver rack and be adjustable in position within the rack. It also must securely hold the components required for quick attachment to the picatinny rail. The main critical structure in the mechanism is the Picatinny pocket. It must be to the exact dimensions required to accept and secure the Picatinny rail. The quick attach lever is constructed of metal, composite or polymer. It is designed to accommodate a roller pin and the quick attach bolt. It must be designed to extend outside the quiver rack so that it is easily accessible by the archer. Its cam shape must interface properly with the Picatinny holder slide to provide tension and a quick release.

The Picatinny pocket is formed into the quick attach mechanism to the precise Picatinny dimensions. The Picatinny holder slide is formed from metal, composite or polymer. Its V-slot must have the same dimensions as the Picatinny V-edge. It has a bolt hole that secures its lateral movement. It also must accommodate a springs in its circular pockets. The Picatinny rail is of the type constructed of aluminum, composite or polymer to the precise military specification Picatinny dimensions. It accommodates being positioned on a shooter's belt as well as mounting to a bow.

The basic elements necessary for this quiver to function are therefore the quiver rack, the quiver head, and the broadhead pocket. These basic elements create a functional quiver that could be mounted directly to the bow with bolts running through the quiver rack. The following elements are important to provide a superior means of mounting the quiver to the bow: the quick attach mechanism with its Picatinny pocket, the Picatinny holder slide, and the Picatinny rail.

The present invention may be characterized as a "double stack quiver" or a "bilateral quiver". The quiver rack supports the two quiver heads as well as the quick attach mechanism. An alternate embodiment of the quiver rack design allows for the rack to telescope to increase or decrease in length. This allows the user to adjust the quiver head spacing distance to accommodate various arrow lengths. The quick attach mechanism can also be moved within the quiver rack to adjust for different bow designs and crossbow applications.

The quiver heads hold the arrow points or broadheads within the broadhead pockets. The broadhead pockets protect the blades of each individual broadhead, as well as prevent blade entanglement. The broadhead pockets also prevent the blades from cutting the shooter. The quiver heads are constructed of rubber and or polymer for flexing capability. The quiver heads have slots between the broadhead pockets that hold onto the arrow shafts. The arrows are snapped into and out of these slots. The quiver heads are clamped onto the quiver rack.

The quick attach mechanism also attaches to the quiver rack. The quick attach mechanism allows for quick attachment and release of the Picatinny rail. The quick attach mechanism is comprised of the quick attach lever, the quick attach bolt, the quick attach nut, the quick attach washer, the quick attach springs, the Picatinny pocket and the Picatinny holder slide. The quick attach lever is shaped as a cam on the end that contacts the Picatinny holder slide. As the lever is rotated towards perpendicular with the bolt, the cam puts more and more pressure on the Picatinny holder slide. This moves the slide inwards toward the center of the Picatinny pocket. The Picatinny holder slide is resisted by the quick attach springs. The springs push against the circular slots in the Picatinny holder slide so that as the quick attach lever is rotated towards parallel with the quick attach bolt, the springs push the Picatinny holder slide out away from the center of the Picatinny pocket. The Picatinny holder slide applies and releases pressure on the Picatinny rail. The Picatinny rail is mounted to the standard IBO accessory holes on the bow. When the quick attach lever is closed, the Picatinny rail is compressed firmly between the Picatinny holder slide and the Picatinny pocket. The pressure on the Picatinny rail can be adjusted by turning the quick attach nut. The quick attach bolt runs through a hole in the center of the Picatinny holder slide. This provides support for the Picatinny holder slide and keeps it properly aligned and secure. With the quiver detached, the Picatinny rail can be utilized to mount other tactical devices that attach to a standardized Picatinny or Weaver style rail. The Picatinny rail is designed with a slot that is sized to accommodate the width and thickness of most belts. The archer can strap this rail to a belt, strap, back pack, etc. This allows the ability to secure the quiver to either the bow or the archer's body.

The present invention provides a securely attached quiver to a bow or crossbow with a minimal amount of required space and weight while securely covering the arrow points or broadheads. The quiver can be quickly detached from the bow using the quick attach lever. Opening the quick attach lever releases pressure on the Picatinny holder slide which is retracted by the quick attach springs. The Picatinny rail is then released from the Picatinny pocket so that the quiver is removed. The quiver heads hold the arrows in alternating directions so as to accommodate minimal space while protecting the broadheads with the broadhead pockets. The quiver heads are attached to the (optionally) telescoping quiver rack. The rack may be adjustable to move the quiver heads closer or further apart to adjust for different arrow lengths and bows. The quiver rack is attached to the quick attach mechanism which is also adjustable in position and houses all of the quick attach components.

The components of the present invention may be fabricated using traditional processes of CNC machining, injection molding, casting, die casting or metal injection molding. After fabrication of the components, the present invention can be easily assembled by hand.

An archer would use this invention in the following way; first, the archer would bolt the Picatinny rail to the standard accessory holes on the bow using the mounting holes typically positioned on the base of the Picatinny rail. The archer would then place the double stack quiver onto the Picatinny rail by setting it into the Picatinny pocket. The archer would then push the quick attach lever into its locked position so that it secures the Picatinny rail between the Picatinny holder slide and the opposing side of the Picatinny pocket. Once the quiver is secured to the archer's bow, the archer would load the arrows into the quiver. To load the arrows the archer first places the broadhead or point into one of the broadhead pockets and then snaps the shaft into the shaft slot in the opposite quiver head. Each arrow will face opposite the other so that all arrows (six in the preferred embodiment) are secured in alternating directions into the quiver. The archer is then ready for the range or the hunt. To remove the quiver, the archer simply moves the quick attach lever into the open position, and the quiver will quickly detach from the Picatinny rail. An alternate use would be to attach the Picatinny rail to the archer's belt, strap, backpack, or the like using a belt slot in the Picatinny rail. The arrows could then be carried in the quiver in this position on the archer's person rather than on the bow.

DETAILED DESCRIPTION OF THE PREFERRED EMBODIMENTS

Figure 1:
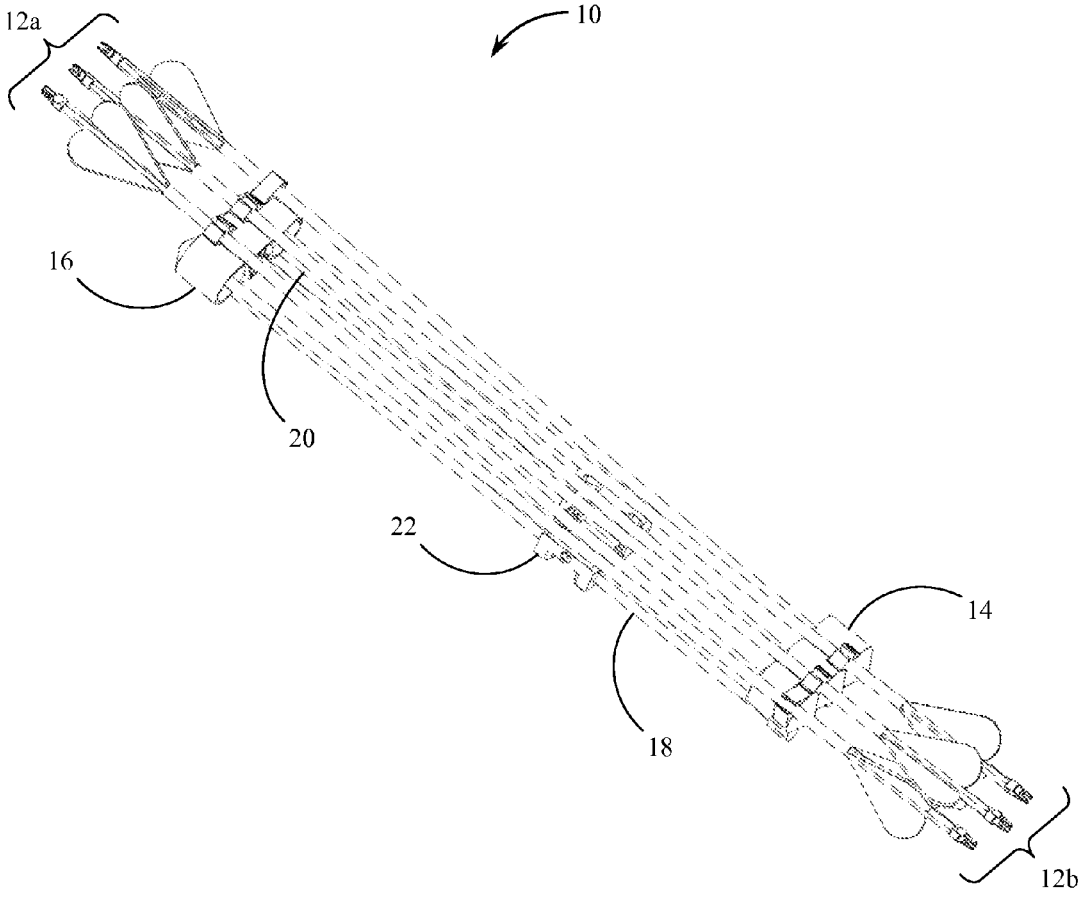
FIG. 1 is a top perspective view of the bilateral quiver of the present invention shown holding a plurality of arrows.
Figure 2:
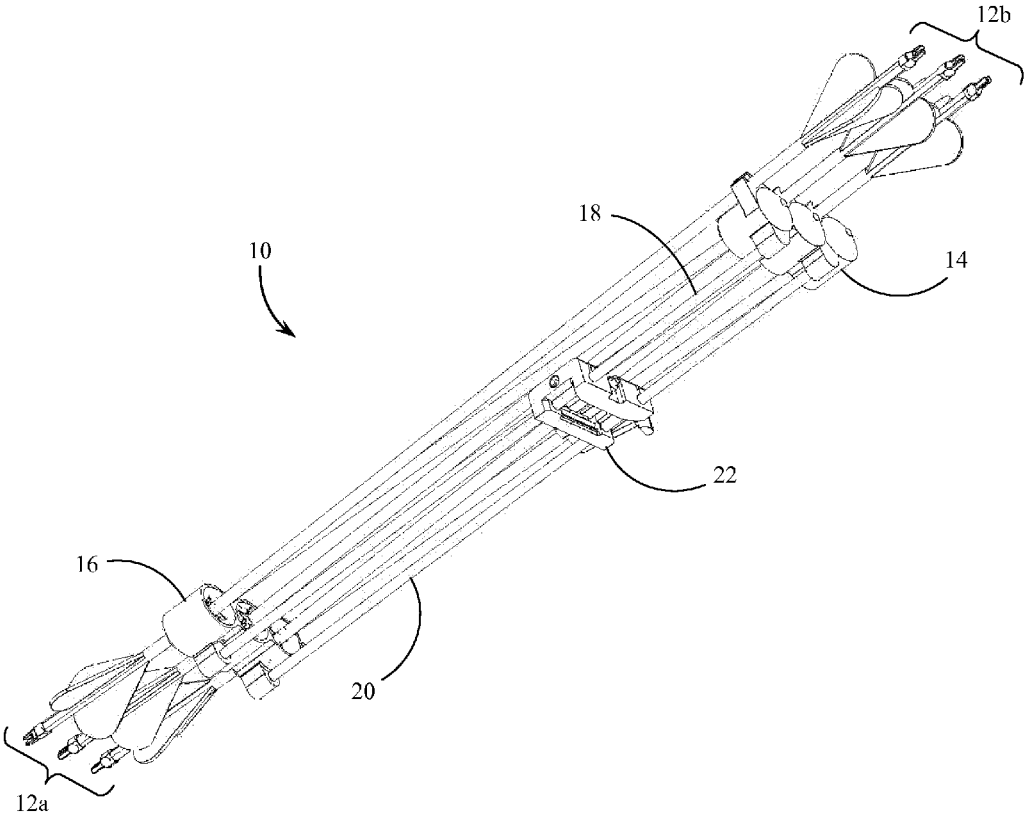
FIG. 2 is a bottom perspective view of the bilateral quiver of the present invention, again shown holding a plurality of arrows, and positioned so as to be attached to a rail mount on a bow.

Reference is first made to FIG. 1 which is a top perspective view of the bilateral quiver of the present invention shown detached from a bow, but with a number of arrows positioned in or on the quiver. Bilateral quiver 10 is shown to be constructed of a number of independent components that are assembled before positioning and placement of the entire quiver 10 onto a mounting rail or plate already positioned on the bow (not shown). In FIG. 1, a first set of arrows 12*a* is shown to be held within the quiver and oriented in a first direction, while a second set of arrows 12*b* is held within the quiver and oriented in an opposing direction. The first set of arrows 12*a* comprises arrows individually positioned within cup-like pockets on first quiver head 14. In a similar manner, the second set of arrows 12*b* are individually positioned in cup-like pockets of second quiver head 16. The first set of arrows 12*a* comprises arrows that are individually secured into clips positioned on second quiver head 16 while the second set of arrows 12*b* are positioned within clips on first quiver head 14. Holding first quiver head 14 in a fixed relationship to second quiver head 16 are connecting rods 18 & 20. Positioned along connecting rods 18 & 20 is rail attachment block 22. The manner in which each of these basic components of bilateral quiver 10 function is described in more detail below, FIG. 2 is a perspective view of the bilateral quiver 10 of the present invention looking up under the quiver on the bow side of the assembly. In this view, first set of arrows 12*a* and second set of arrows 12*b* are again shown positioned as described above on first quiver head 14 and second quiver head 16. Connecting rods 18 & 20 are shown to extend between rod retention pockets positioned on first quiver head 14 and similar pockets positioned on second quiver head 16. Connecting rods 18 & 20 extend through (in a clamped manner as described below) rail attachment block 22. In the view of FIG. 2, the underside of rail attachment block 22 is shown to include a rail attachment aperture (the Picatinny pocket described above) into which a rail or plate fixed to the bow stock may be inserted and secured by the mechanism of rail attachment block 22. A Picatinny rail attachment mechanism may be used in the preferred embodiment of the present invention. Such a rail structure may be inserted into the Picatinny pocket configured in rail attachment block 22 in a manner that allows the quiver to be easily attached to or removed from the bow.

Figure 3:
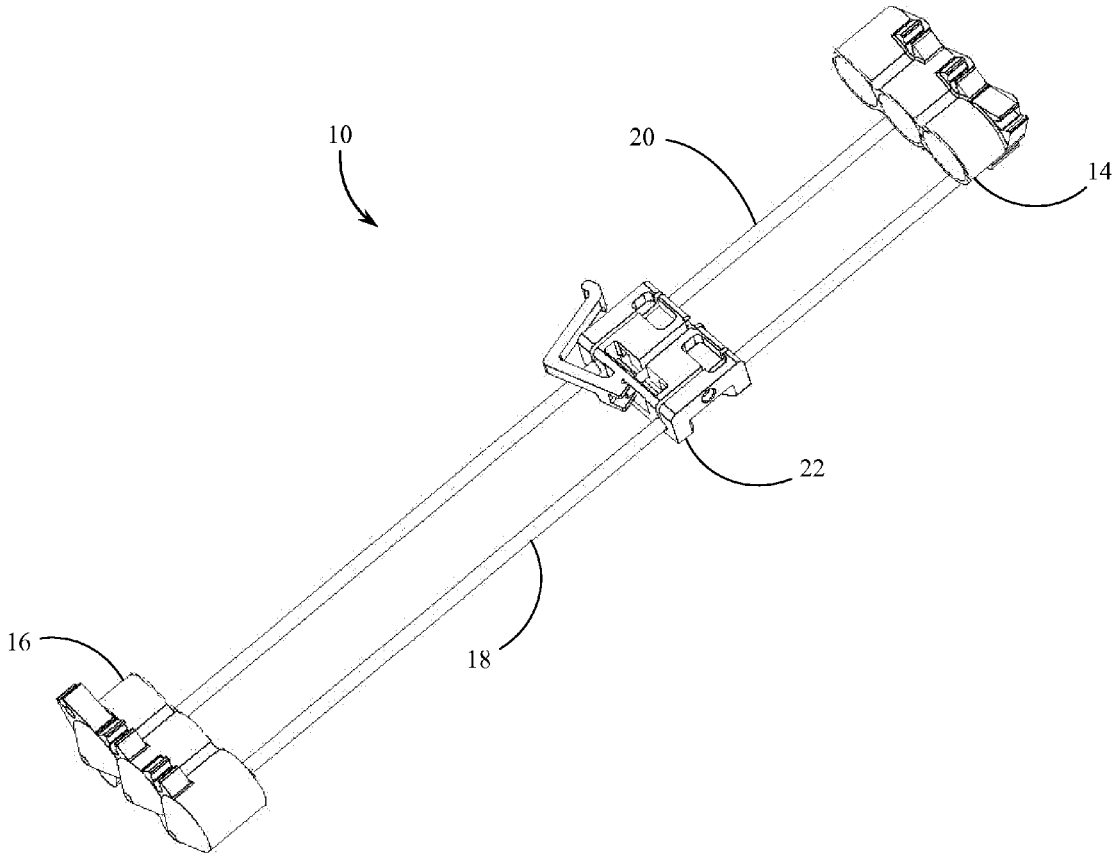
FIG. 3 is a top perspective view of the bilateral quiver of the present invention shown removed from the bow and absent any arrows.
Figure 4:
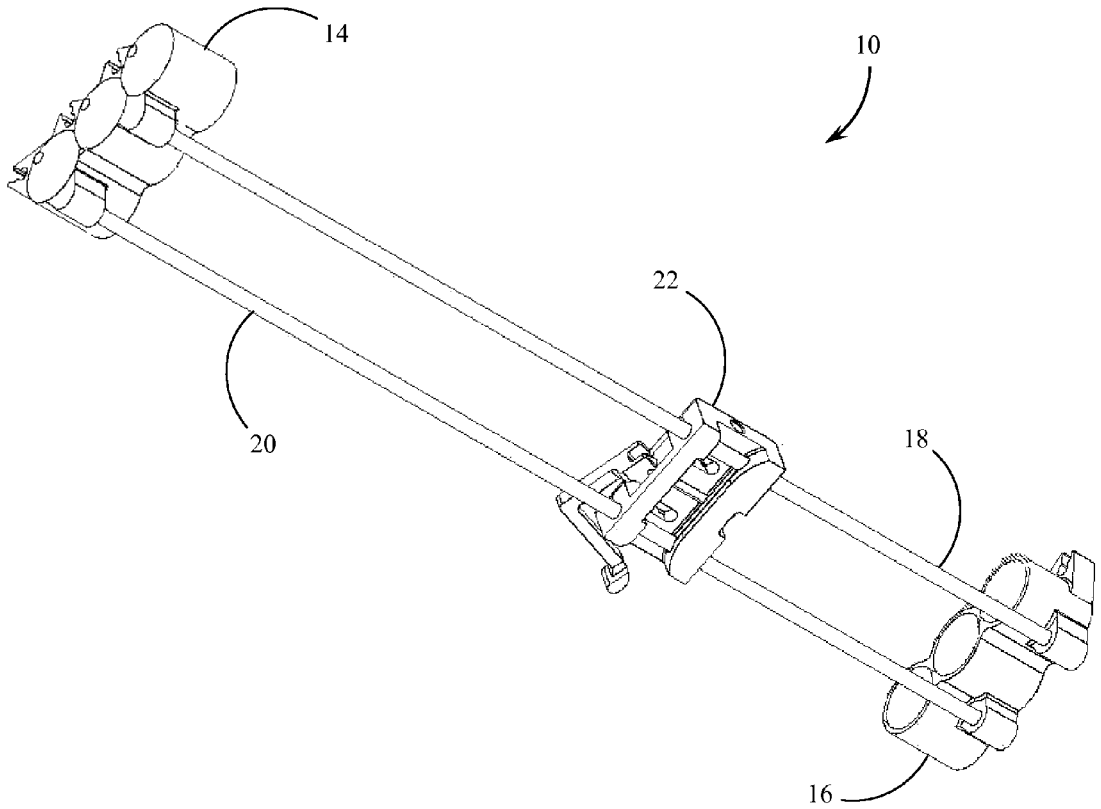
FIG. 4 is a bottom perspective view of the bilateral quiver of the present invention, again shown without arrows, and positioned so as to be mounted on a rail mount on a bow.

FIGS. 3 & 4 are perspective views of the bilateral quiver assembly of the present invention shown without the plurality of arrows positioned on the assembly as shown above in FIGS. 1 & 2. In FIG. 3, the side of the quiver facing away from the bow stock is shown in greater detail. In this view, first quiver head 14 and second quiver head 16 are shown. In the preferred embodiment, these components of the quiver assembly are made up of three formed cups or pockets that hold the arrow heads of the respective arrows positioned therein. Associated with each quiver head are also three clips, oriented and spaced so as to hold the fletch ends of the arrows that are inserted into the pockets of the opposing quiver head component.

Connecting rods 18 & 20 are shown as they extend between friction fit pockets configured into the molded quiver heads (described in more detail below) and thereby fix the quiver head components at a set distance from each other. In an alternate embodiment of the present invention, connecting rods 18 & 20 may comprise telescoping components that would allow the length of the quiver to be adjusted for arrows and/or bows of varying length. It would be recognized, however, that because the shaft clips on the quiver head components need not attach to the arrow shaft at any particular point near the fletch end of the arrow, there is already much variability in the length of the arrows that can be accommodated, even with fixed length connecting rods. In other words, some variation in the length of the arrow is already accommodated by the manner in which the arrow shafts are held within the quiver. Greater variability may be accomplished by utilizing telescoping or otherwise length adjustable connecting rods 18 & 20.

The view in FIG. 3 of rail attachment block 22 discloses the manner in which the rail block may be secured to a Picatinny rail type attachment that is fixed to the bow stock. The simple movement of the lever on rail attachment block 22 (described in more detail below) allows for the easy attachment or removal of the attachment block and therefore of the quiver to the bow stock.

FIG. 4 shows in detail the bow side of the quiver assembly disclosing the Picatinny pocket within rail attachment block 22. The view of FIG. 4 also shows in greater detail the manner in which connecting rods 18 & 20 extend between fixed retention pockets on the first and second quiver heads 14 & 16 so as to fix the length of the bilateral quiver 10.

Figure 5:
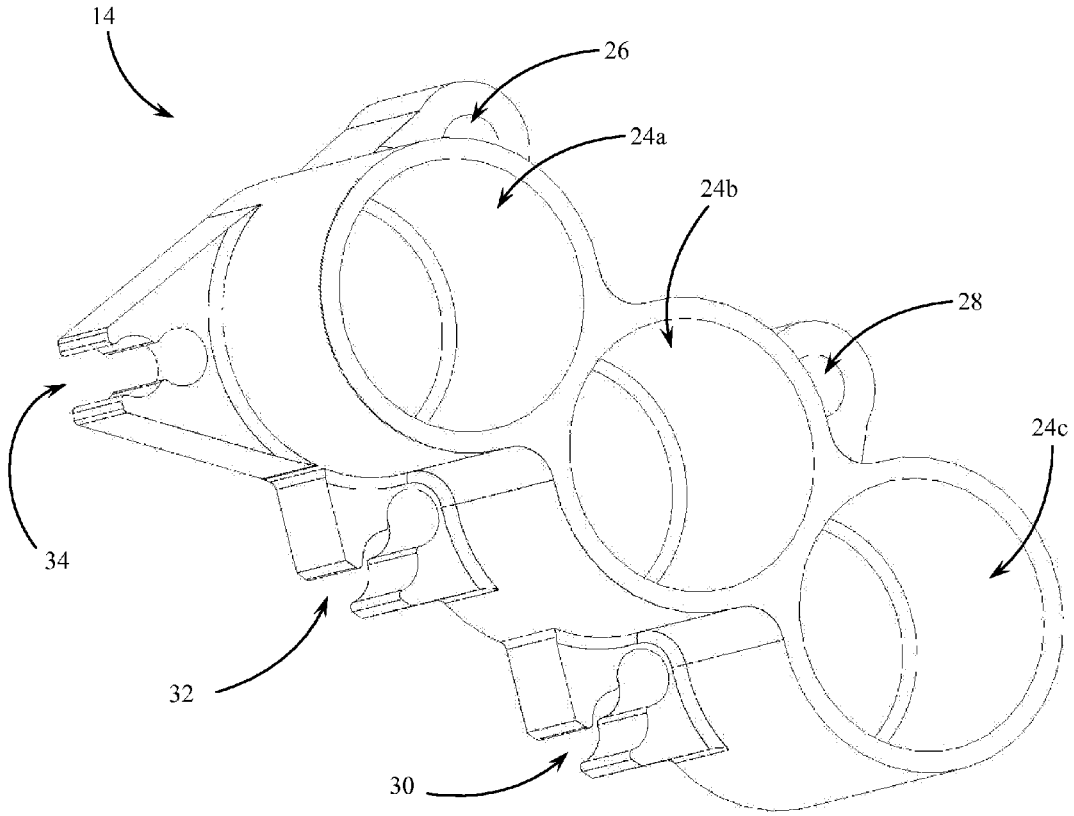
FIG. 5 is a detailed interior perspective view of one of the two quiver head components of the present invention showing the arrow head pockets and the clips.
Figure 6:
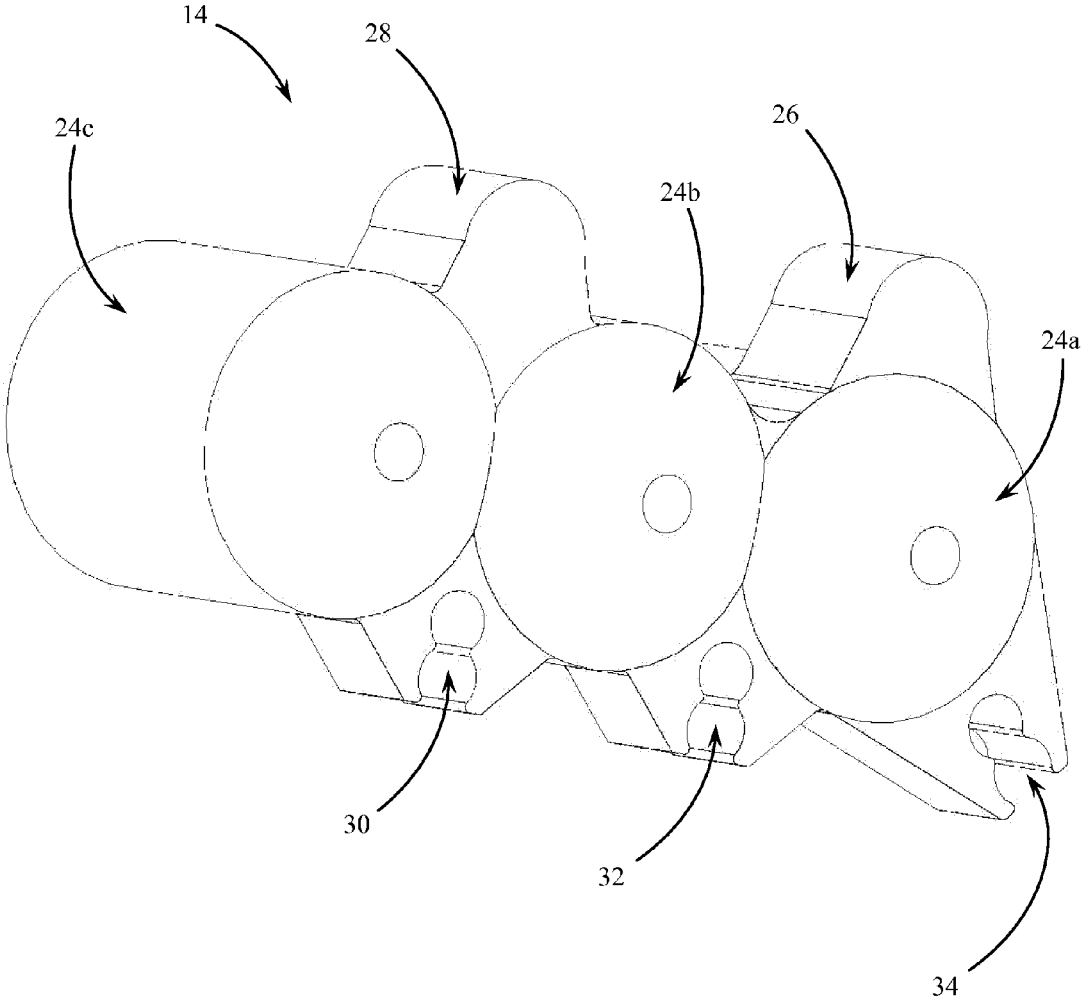
FIG. 6 is a detailed exterior perspective view of one of the two quiver head components of the present invention.

FIGS. 5 & 6 are perspective views of the quiver head components of the present invention showing the structure that allows for the retention of a first set of arrow heads and the corresponding retention of a second set of arrow shafts. In the preferred embodiment of the present invention, the quiver head components may be polymer plastic molded components that are identical in structure whereby a duplicate of the component may be oriented 180° about from the first component so as to provide the appropriate structure for the overall quiver assembly. For this reason FIGS. 5 & 6 provide as an example, a view of the first quiver head 14 and it is understood that the second quiver head 16 comprises an identical component that has simply been flipped around to form the opposing end of the quiver.

The quiver head component shown in FIGS. 5 & 6 are structured to, in combination, receive and retain a total of six arrows, including arrows with broadhead points. Smaller or larger quivers may be constructed by increasing or decreasing the number of pockets and clips molded and constructed into each quiver head component. First quiver head 14 as shown in FIG. 5 is constructed of a unitary polymer plastic material and provides (for example) three broadhead pockets 24*a*-24*c*. Positioned on one side of broadhead pockets 24*a*-24*c* are two connecting rod pockets 26 & 28. These closed connecting rod pockets receive and secure the connecting rods (now shown in this view) and thereby establish the length of the overall quiver assembly. On an opposing side of broadhead pockets 24*a*-24*c* are positioned first arrow clip 30 (between broadhead pockets 24*b* & 24*c*), second arrow clip 32 (between broadhead pockets 24*a* & 24*b*), and third arrow clip 34 positioned at an angle to and offset from broadhead pocket 24*a*. In this manner, first quiver head 14 provides the end of the quiver for receiving three arrow heads and protecting the tips of these arrow heads, as well as securing three arrow shafts, separating the arrow shafts from the parallel placed arrow heads. The clips are preferably provided with double deep slots that allow for a firm retention of the shafts. The archer will withdraw an arrow from the quiver by popping the shaft out of the clip structure and then lifting the arrow head out from the pocket structure. FIG. 6 discloses an exterior perspective view of the quiver head structure of the present invention disclosing each of the same primary structural components as described above in FIG. 5.

Figure 7:
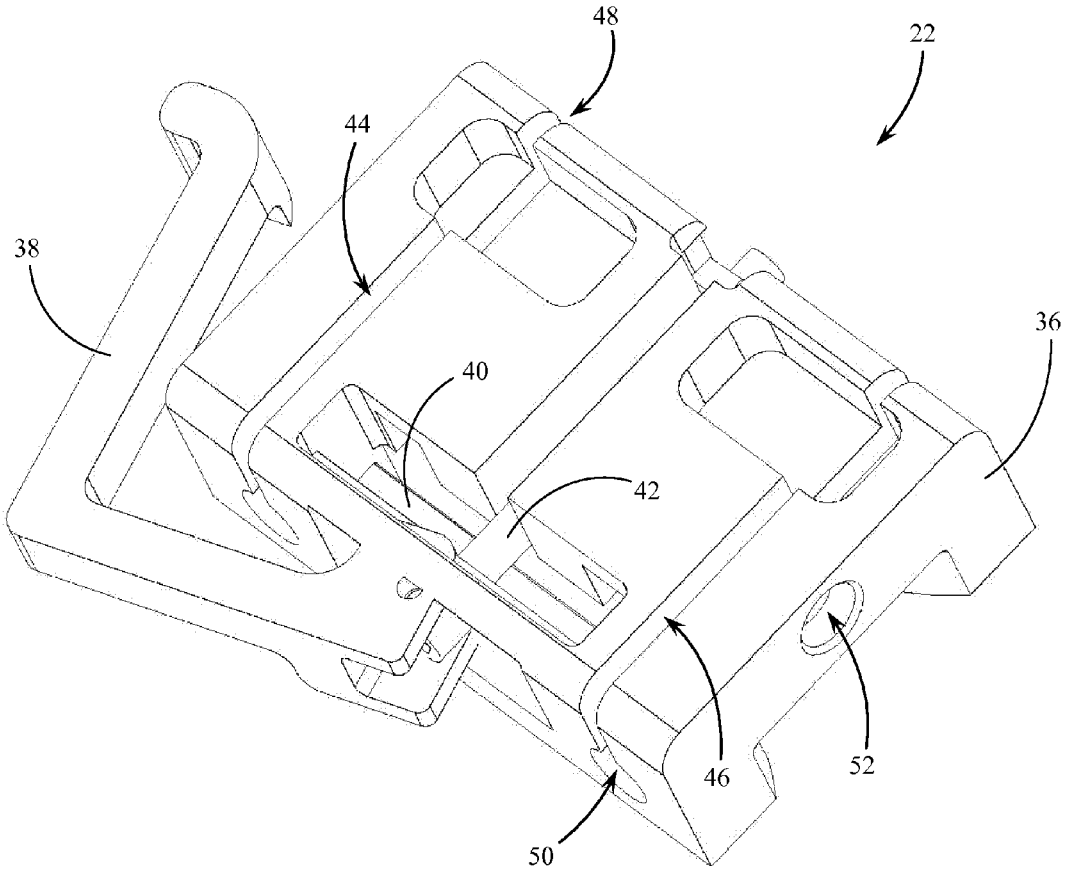
FIG. 7 is a detailed top perspective view of the rail attachment block of the quiver assembly of the present invention.

FIG. 7 is a detailed perspective view of the rail attachment block 22 of the present invention. In the view of FIG. 7, the rail attachment block is shown removed from both the rail attachment plate (the Picatinny rail in the preferred embodiment) fixed to the bow stock and is also shown removed from the connecting rods that attach the block to the balance of the quiver assembly. The view of FIG. 7 is that of the outside of the quiver assembly away from the bow stock with the Picatinny pocket being positioned on the underside of rail attachment block 22.

Rail attachment block 22 is constructed primarily of attachment block body 36 and moveable cam lever 38. Cam lever 38 is attached to cam bolt 42 and, by pivoting on a pin through cam bolt 42, moving rail plate 40 into and out of position for attachment to a Picatinny rail type structure (not shown). Also configured within attachment block body 36 are connecting rod clamps 44 & 46, each associated with connecting rod slots 48 & 50 as shown. Clamp bolt apertures are utilized with threaded bolts to close the connecting rod clamps and secure the rail attachment block to the connecting rods.

Figure 8:
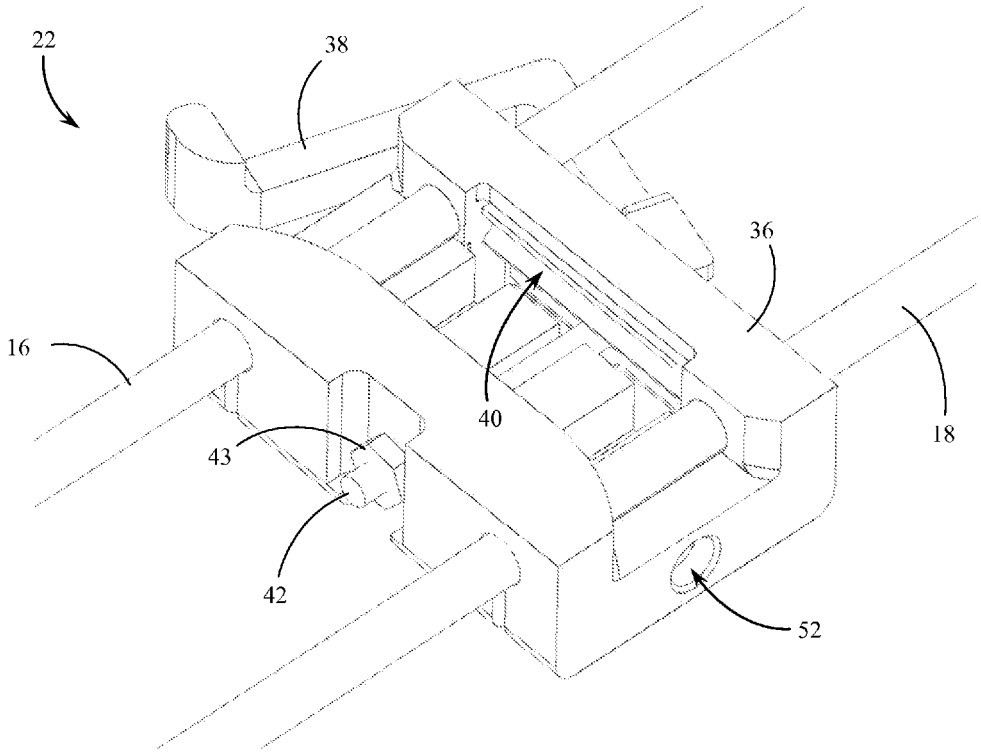
FIG. 8 is a detailed bottom perspective view of the rail attachment block of the quiver assembly of the present invention shown with connecting rods in place.

FIG. 8 is a further detailed perspective view of rail attachment block 22, this time showing the underside or the side that is directed towards the bow stock and into which is attached the Picatinny rail. In FIG. 8, the opposite end of cam bolt 42 is shown extending through attachment block body 46 opposite from its attachment to cam lever 38. Moving rail plate 40 is shown in this interior view of the Picatinny pocket positioned on rail attachment block 22. Rotation of cam lever 38 moves moving rail plate 40 in and out from the rectangular Picatinny pocket thereby engaging or disengaging the Picatinny rail attachment. Hex nut 43 secures one end of cam bolt 42 and may be used to adjust the tightness of the cam lever fit. Cam lever 38 secures the opposing end of the cam bolt. In the preferred embodiment of the present invention, a spring is positioned around cam bolt 42 in a manner that preferences the movement of moving rail plate 40 apart when cam lever 38 is released. Once again, clamp bolt apertures 52 & 54 are positioned through the sides of attachment block body 36, and when utilized in connection with threaded bolts are designed to close the connecting rod clamps so as to secure rail attachment block 22 in position onto connecting rods 18 & 20.

Figure 9:
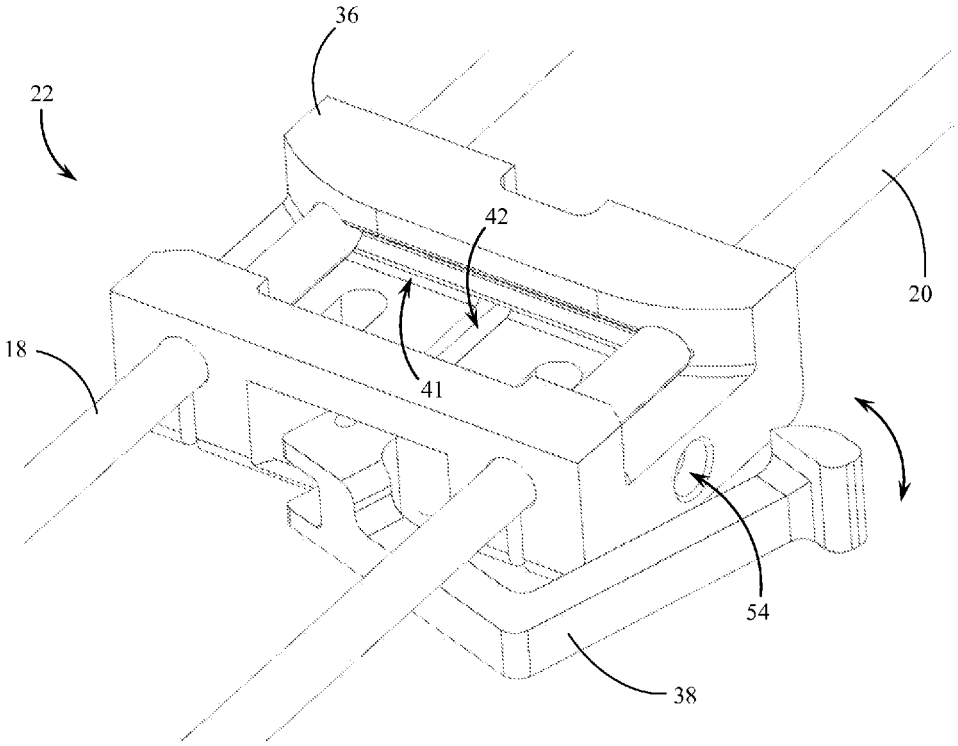
FIG. 9 is a detailed perspective view of the rail attachment block of the quiver assembly of the present invention, again shown with connecting rods in place, and positioned for attachment to a rail mount on a bow.

FIG. 9 discloses the same components of rail attachment block 22 as described above in conjunction with FIG. 8 but more clearly shows the fixed rail plate 41 positioned within the Picatinny pocket of rail attachment block 22 that serves as an opposing attachment point for the Picatinny rail inserted therein. Between moving rail plate 40 and fixed rail plate 41, the typical Picatinny rail structure may be gripped or ungripped, thereby attaching or releasing the quiver assembly from the bow.

Figure 10:
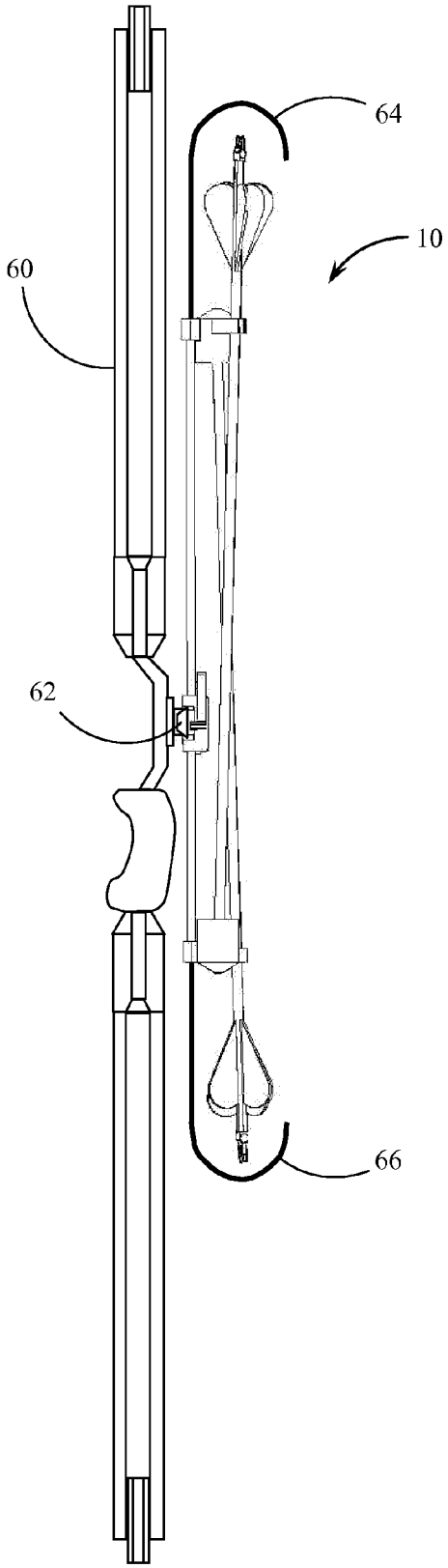
FIG. 10 is an elevational plan view showing the bilateral quiver of the present invention attached to a typical compound longbow and further including fletch guards.

Reference is next made to FIG. 10 which is an elevational rear view (forward looking) of the quiver of the present invention attached to a typical compound longbow. In this view, quiver 10 is shown attached to bow 60 by way of a Picatinny rail attachment plate 62 secured near the handle component of bow 60. It is anticipated that various other mechanisms for releasably attaching the quiver of the present invention to a bow are possible. Alternate mechanisms for attaching such quivers to bows have been explored in the prior art, although the preferred embodiment of the present invention utilizes a novel Picatinny rail attachment for securing and positioning the quiver with respect to the bow stock. Also shown in FIG. 10 are optional fletch guard plates 64 & 66 positioned on either end of the quiver 10 to prevent damage that might occur to the feather or fletch ends of the arrows as when the archer may carry the bow and quiver assembly through underbrush and the like.

Figure 11:
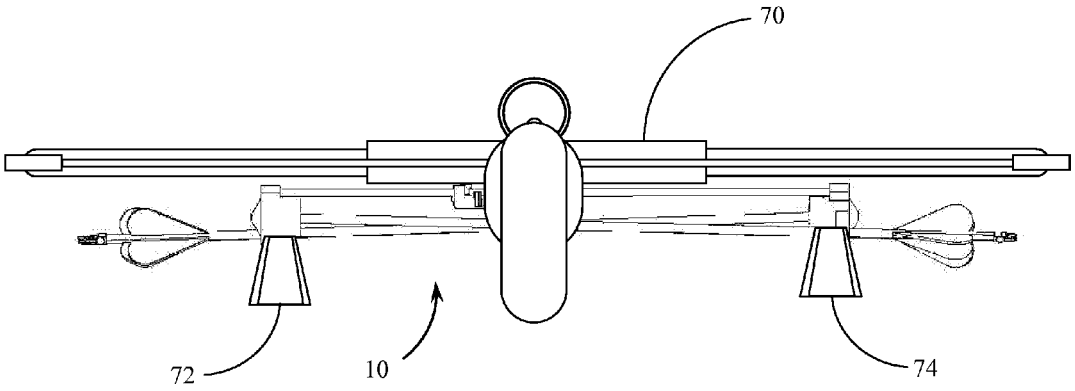
FIG. 11 is an elevational plan view of the bilateral quiver of the present invention shown attached to a crossbow and further including pedestal feet for supporting the crossbow on a flat surface.

FIG. 11 is an elevational rear (forward looking) view of the quiver of the present invention shown attached to a crossbow structure in a manner similar to that associated with the compound longbow. In a manner likewise utilizing a Picatinny rail attachment plate, the quiver 10 of the present invention may be attached to the underside of a typical crossbow 70. Further features, primarily appropriate for use in conjunction with the crossbow embodiment of the present invention are shown in FIG. 11, and include pedestal feet 72 & 74 that extend from each of the quiver head components of the quiver at distance to provide support for the crossbow when the bow and quiver assembly may be placed on a flat horizontal surface. Further variations with regard to support pedestals or covers are anticipated and may be incorporated into the unitary molded construction of each of the quiver head components described above.

Although the present invention has been described in terms of the foregoing preferred embodiments, this description has been provided by way of explanation only, and is not intended to be construed as a limitation of the invention. Those skilled in the art will recognize modifications in the present invention that might accommodate specific bow structures and specific types of arrows or bolts. Such modifications as to structure, size, and even the specific arrangement of components, where such modifications are coincidental to the type of bow or type of arrow being used, do not necessarily depart from the spirit and scope of the invention.

We claim:

1. A quiver for releasably retaining a plurality of arrows or bolts, the quiver releasably attachable to a mount, the quiver comprising:

(a) a longitudinal frame having a first end, a second end, and a mid-section;

(b) a first end member comprising a first plurality of enclosed arrow head pockets and a first plurality of arrow shaft clips external to said first enclosed arrow head pockets the first end member positioned and secured on the first end of the longitudinal frame;

(c) a second end member comprising a second plurality of enclosed arrow head pockets and a second plurality of arrow shaft clips external to said second enclosed arrow head pockets the second end member positioned and secured on the second end of the longitudinal frame; and (d) a mounting block positioned and secured on the mid-section of the longitudinal frame, the mounting block comprising an attachment mechanism for releasably attaching the quiver to the mount;

wherein a first plurality of arrows may be positioned with their arrow heads in the first plurality of arrow head pockets and with their arrow shafts in the second plurality of arrow shaft clips and a second plurality of arrows may be positioned with their arrow heads in the second plurality of arrow head pockets and with their arrow shafts in the first plurality of arrow shaft clips, whereby the first plurality of arrows are oriented in a direction opposite the orientation of the second plurality of arrows.

2. The quiver of claim 1 wherein the mounting block is moveably positioned on the mid-section of the longitudinal frame.

3. The quiver of claim 1 wherein the longitudinal frame comprises at least two parallel connecting rods having a length.

4. The quiver of claim 3 wherein the mounting block is moveably positioned along the length of the at least two parallel connecting rods.

5. The quiver of claim 4 wherein the mounting block further comprises connecting rod clamps and the mounting block is moveably secured to the at least two connecting rods with the connecting rod clamps.

6. The quiver of claim 5 wherein the connecting rod clamps each further comprise clamp arms and a threaded tightening bolt.

7. The quiver of claim 3 wherein the first and second end members each further comprise connecting rod pockets.

8. The quiver of claim 1 wherein the plurality of arrow shaft clips each further comprise double-deep slotted arrow clips spaced between the arrow head pockets.

9. The quiver of claim 1 wherein the first and second plurality of arrow head pockets each comprise three broadhead pockets and the first and second plurality of arrow shaft clips each comprise three arrow shaft clips.

10. The quiver of claim 1 further comprising at least one fletch guard plate positioned on each of the first and second end members and oriented to protect the ends of the plurality of arrows in the quiver from a bow string.

11. The quiver of claim 1 further comprising at least one pedestal foot positioned on each of the first and second end members and oriented to support a bow and quiver assembly when placed on a horizontal surface.

12. The quiver of claim 1 wherein the first and second end members are movably positioned and releasably secured on the longitudinal frame to allow an overall length of the quiver to be adjusted for arrows of varying length.

13. The quiver of claim 1 wherein the first and second end members are each molded from a single form to create a unitary, molded, end member component that is interchangeable to function as either a first end member or second end member.

14. The quiver of claim 1 wherein the mount to which the quiver is releasably attachable is positioned on a bow.

15. The quiver of claim 1 wherein the mount comprises a rail and the mounting block comprises a rail attachment clamp.

16. The quiver of claim 15 wherein the rail attachment clamp comprises a fixed rail plate, a moving rail plate, and a cam lever, whereby rotation of the cam lever directs the moving rail plate alternately towards and apart from the fixed rail plate to engage or disengage the rail to alternately grip or release the mount.

17. The quiver of claim 16 wherein the rail comprises a Picatinny rail attachment mount.

18. A quiver for releasably retaining a plurality of arrows or bolts, the quiver releasably attachable to a mounting rail, the quiver comprising:

(a) a longitudinal frame having a first end, a second end, and a mid-section, the longitudinal frame comprising at least two parallel connecting rods having a length;

(b) a first end member comprising a first plurality of enclosed arrow head pockets, a first plurality of arrow shaft clips external to said first enclosed arrow head pockets and a first plurality of connecting rod pockets, the first end member positioned and secured on the first end of the longitudinal frame;

(c) a second end member comprising a second plurality of enclosed arrow head pockets and a second plurality of arrow shaft clips external to said second enclosed arrow head pockets and a second plurality of connecting rod pockets, the second end member positioned and secured on the second end of the longitudinal frame; and (d) a mounting block moveably secured to the at least two connecting rods with connecting rod clamps positioned and secured on the mid-section of the longitudinal frame, the mounting block comprising a rail attachment clamp, the rail attachment clamp comprising a fixed rail plate, a moving rail plate, and a cam lever, whereby rotation of the cam lever directs the moving rail plate alternately towards and apart from the fixed rail plate to engage or disengage the rail to alternately grip or release the mounting rail, the mounting block further comprising connecting rod clamps, the mounting block moveably secured to the at least two connecting rods with the connecting rod clamps;

wherein a first plurality of arrows may be positioned with their arrow heads in the first plurality of arrow head pockets and with their arrow shafts in the second plurality of arrow shaft clips and a second plurality of arrows may be positioned with their arrow heads in the second plurality of arrow head pockets and with their arrow shafts in the first plurality of arrow shaft clips, whereby the first plurality of arrows are oriented in a direction opposite the orientation of the second plurality of arrows.

* * * * *